US005720263A

United States Patent [19]

Frank et al.

[11] Patent Number: 5,720,263

[45] Date of Patent: Feb. 24, 1998

[54] DEVICE FOR SUPPLYING INTERNAL COMBUSTION ENGINE WITH FUEL FROM SUPPLY

[75] Inventors: Kurt Frank, Schorndorf; Ansgar Seitz, Neuhausen; Albert Gerhard, Tamm, all of Germany

[73] Assignee: Robert Bosch GMBH, Stuttgart, Germany

[21] Appl. No.: 818,798

[22] Filed: Mar. 14, 1997

[30] Foreign Application Priority Data

May 9, 1996 [DE] Germany ..... 1 96 18 647.1

[51] Int. Cl.[6] ..... F02M 37/04

[52] U.S. Cl. ..... 123/514; 123/459; 137/510; 137/505.46

[58] Field of Search ..... 123/514, 509, 123/459, 463, 456, 497; 137/510, 116, 505.46

[56] References Cited

U.S. PATENT DOCUMENTS

| | | | |
|---|---|---|---|
| 4,067,355 | 1/1978 | St. Clair | 137/505.46 |
| 4,903,721 | 2/1990 | Maier | 137/510 |
| 5,070,849 | 12/1991 | Rich | 123/514 |
| 5,088,463 | 2/1992 | Affeldt | 123/514 |
| 5,103,861 | 4/1992 | Lin | 137/505.46 |
| 5,176,176 | 1/1993 | Lewis | 137/510 |
| 5,186,147 | 2/1993 | Bellis | 137/510 |
| 5,381,816 | 1/1995 | Brooks | 137/510 |
| 5,389,245 | 2/1995 | Jaeger | 123/514 |
| 5,564,397 | 10/1996 | Kleppner | 123/514 |
| 5,606,991 | 3/1997 | Ruribayashi | 137/510 |

*Primary Examiner*—Carl S. Miller
*Attorney, Agent, or Firm*—Michael J. Striker

[57] ABSTRACT

A device for supplying an internal combustion engine with fuel has a supply container from which the fuel is supplied and having an opening, a feed pump arranged in the supply container and insertable into the supply container through the opening, a closure part for closing the opening of the supply container, a pressure regulator arranged on the closure part and having a pressure chamber with a connection to a pressure side of the feed pump, to an internal combustion engine and to an unloading chamber, the closure part having a flange-shaped base body which closes the opening and is provided with a depression, a pipe formed of one piece with the body for forming a connection of the pressure chamber to the unloading chamber and extending into the depression, an elastically deformable diaphragm group which closes the depression for forming the pressure chamber, the pipe having a seat with which diaphragm group at least partially directly cooperates, a spring loading the diaphragm group toward the pipe so that during the exceeding a predetermined pressure in the pressure chamber the pipe for connecting the pressure chamber with the unloading chamber is released, the diaphragm group being mountable to the base body, a holding element arrangeable on the closure part, and an insert part engageable with the spring and movable axially relative to the holding element.

10 Claims, 1 Drawing Sheet

DEVICE FOR SUPPLYING INTERNAL COMBUSTION ENGINE WITH FUEL FROM SUPPLY

BACKGROUND OF THE INVENTION

The present invention relates to a device for supplying an internal combustion with fuel from a supply container.

Devices of the above mentioned general type are known in the art. One of such devices is disclosed, for example in the German patent document DE 44 02 224 A1. This device has a feeding pump arranged in the supply container and insertable through an opening into the supply container. The opening in the supply container is closeable with a closing part, in which a pressure regulator is arranged. The pressure regulator has a pressure chamber which has a connection to a pressure side of the feed pump, to the internal combustion engine, and to an unloading conduit. The closure part has a flange-shaped base body which is composed of synthetic plastic material and closes the opening. A depression is formed in the base body. A pipe which is formed of one-piece with the base body and forms a connection of the pressure chamber to the unloading chamber extends into the depression. The depression of the base body is covered with an elastically deformable diaphragm for forming the pressure chamber. The diaphragm cooperates directly with the end side of the pipe as a seat. The diaphragm is loaded by a spring toward the pipe. When a predetermined pressure in the pressure chamber is exceeded, the diaphragm releases the pipe for connection of the pressure chamber with the unloading chamber. The diaphragm is mounted to the base body. It has been determined that during the mounting of the holding element to the base body, a bending of the spring can occur. Thereby the diaphragm can be displaced from its ordinary position toward the pipe which extends in the unloading chamber. As a result the pressure regulator becomes untight, and accurate adjustments are no longer guaranteed.

SUMMARY OF THE INVENTION

Accordingly, it is an object of present invention to provide a device for supplying an internal combustion engine with fuel from a supply container in which on the closure part, a holding element is bringable which receives an insert engageable with a spring and movable axially to the holding element.

When the device is designed in accordance with the present invention it has the advantage that a mounting of the holding element to the closure part can be performed and no forces are transmitted on the diaphragm. Because of the insert part which is movable axially relative to the holding element, the holding element can be arranged during the mounting so that the insert during the mounting of the holding element is free from occurring forces.

In accordance with another feature of the present invention, a screw connection can be provided for fixing the holding element to the closure part. Thereby a precise adjustment of the holding element is possible, and a spring force acting on the diaphragm group is adjustable. As a result, a precise adjustment of the open pressure is performed. During this adjusting process the insert is held down relative to the holding element so that no torsion moment can be transferred during the mounting of the holding element through the spring to the diaphragm group.

In accordance with a further feature of the present invention, the screw connection is formed as a self-securing thread. In this case the holding element is secured from an unintentional loosening from the closure part.

In accordance with still a further advantageous feature of the present invention, before the mounting of the holding element, to the closing part is arrangeable with a separate ring element. Therefore, before the mounting of the holding element to the closure part, the diaphragm group is fixable to the closure part. Thereby the diaphragm group can be positionable in a definite position to the pipe leading into the unloading chamber and mountable to the closure part. Thus a tightly closing arrangement of the diaphragm group to a pipe leading into the unloading chamber can be provided.

In accordance with still a further feature of present invention, the insert has a guiding portion extending from the opening of the holding element, and the length of the guiding portion is selected so that during the mounting of the holding element the spring plate of the insert part is arrangeable at a distance to the opening of the holding element. In such construction the insert during the total mounting step of the holding element to the closure part with a guiding portion toward the opening of the holding element in which the insert part is guided over the guiding portion, is arrangable with a distance so that the holding element is mountable without transmission of forces to the insert part and thereby to the membrane group toward the closure part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
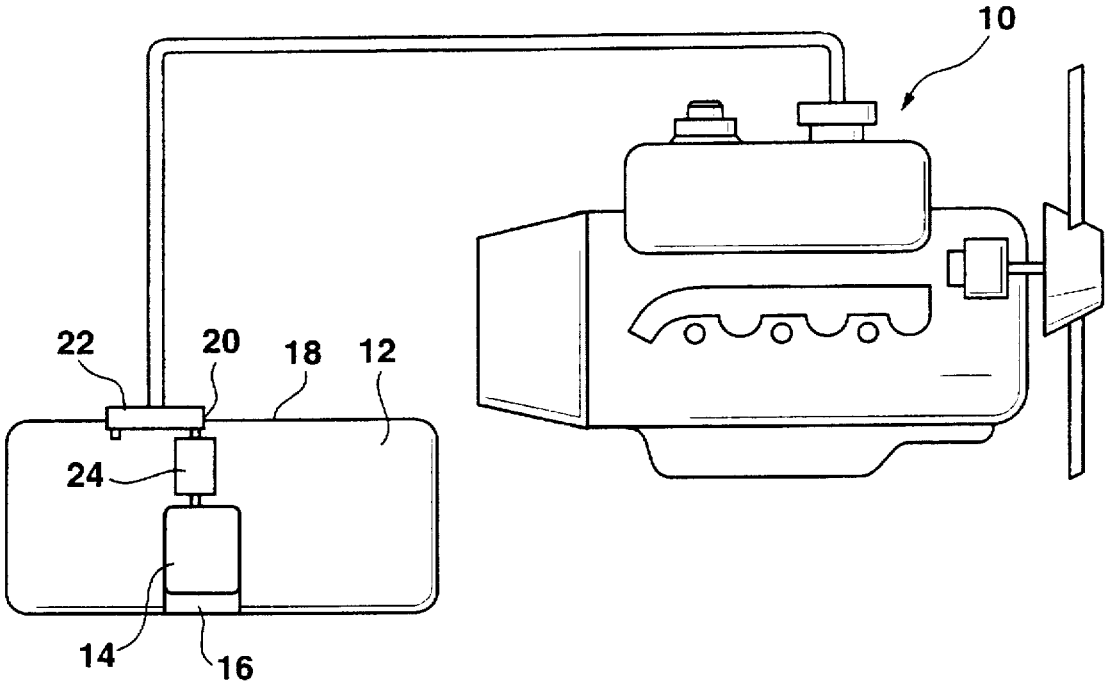
FIG. 1 is a view showing a device for supplying an internal combustion engine with fuel from a supply container.

A device shown in FIG. 1 in a simplified manner serves for supplying an internal combustion engine 10 with fuel from a supply container 12. The supply container 12 has a feed pump 14 arranged in the container and held there in a not shown manner. The feed pump 14 is formed in any way. It aspirates fuel at its suction side from a reservoir 16 in the supply container 12. The supply container 12 is provided with an opening 20 in its wall 18. The feed pump 14 can be inserted into the supply container through the opening 20. After insertion of the feed pump 14, the opening 20 is closable with a closure part 22. A conduit passes through the closure part 22 for connection of the pressure side of the feed pump 14 with the internal combustion 10. A fuel filter 24 can be arranged in the connection of the pressure side of the feed pump 14 with the closure part 12.

Figure 2:
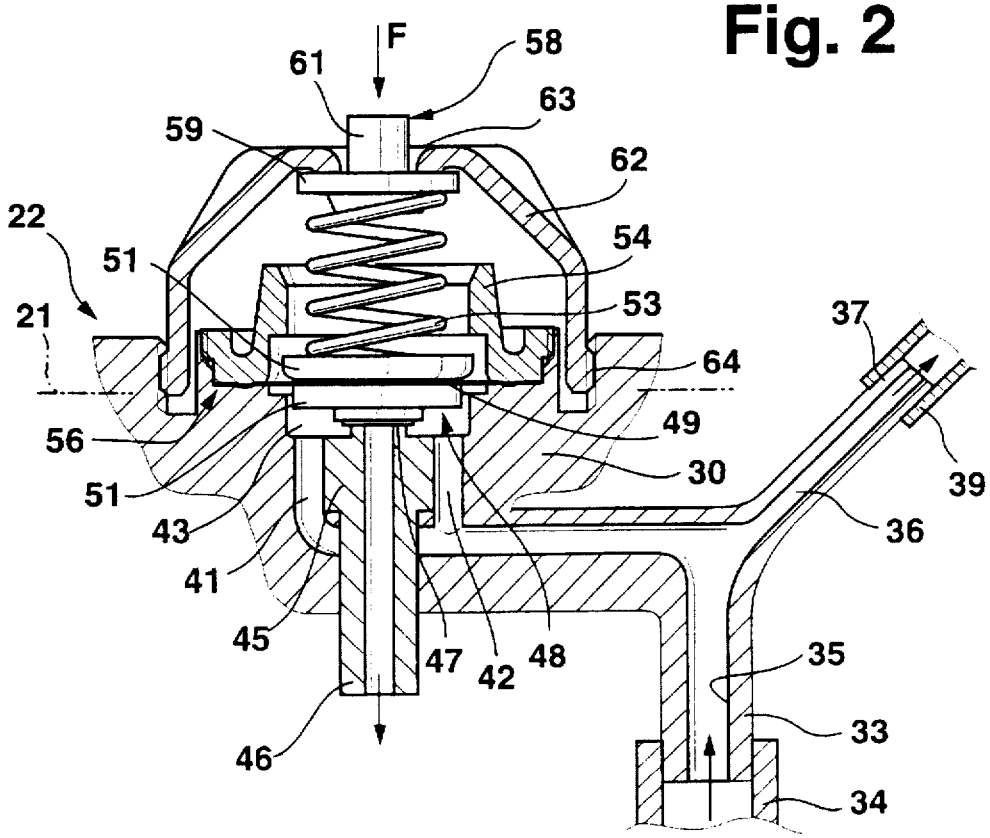
FIG. 2 is a schematic cross-section of a pressure regulator of the inventive device.

FIG. 2 shows the inventive design of the closure part 22. The closure part 22 has a flange-like base body 30 produced by injection molding of synthetic plastic material. It covers the opening 20 in the supply container 12. A sealing element is arranged between an outer edge of the closure part 22 and the wall 18 of the supply container 12. The closure part 22 is mounted in a not shown manner on the supply container 12.

The positions identified hereinbelow on the closure part 22, are such that an arrangement inwardly means into the supply container 12 and the arrangement outwardly means away from the supply container 12.

The connecting pipe 33 is formed on the base body 30 of one-piece with it and extends inwardly. A conduit 34 is connected with the connecting pipe 30 for a connection with the pressure side of the feed pump 14. A further connecting pipe 37 extends moreover outwardly from the base body 30, and a conduit 39 is connectable with the connecting pipe 37 for connection with the internal combustion engine 10. The connecting pipe 33 and 37 are connected with one another by passages 38 and 36 formed in the base body 30. The passage 35 of the connecting pipe 33 extends substantially perpendicularly to the plane 21, in which the opening 20 is arranged. The passage 36 of the connecting pipe 37 extends inclinedly from this plane 21 outwardly. The passage 36 opens through two openings 41 and 42 into a depression 43. The depression 43 in a cross-section extending parallel to the plane 21 in which the opening 20 is located, can be round or cornered. A pipe 45 is arranged centrally to the depression 43 on the base body 30. It has a connecting pipe 45 inwardly with a conduit connected with the pipe 46. The pipe 45 has a seat 47 facing outwardly and closed by a diaphragm group 48. The diaphragm group 48 has a diaphragm 49 with a plate 51 arranged on its inwardly facing side. The plate 51 abuts against the seat 47 in the closing position and tightly closes the pipe 45. The plate 51 is associated with the outwardly oriented plate 52 which receives a spring 53.

The diaphragm 49 is mounted in the edge region to the base body 30 through a ring element 54. The ring element 54 is composed for example of synthetic plastic material. After the diaphragm with its edge region is positioned against a shoulder 56 of the base body 30, the ring segment 54 is positioned to the shoulder 46. The ring element 54 can be fixed by ultrasound welding or friction welding to the base body 30. Similarly, glueing or fixing in another way on the base body 30 is possible.

After the diaphragm group 48 is fixed to the base body 30, the spring 53 is mounted on the plate 52. An insert 58 is arranged on the end of the spring 53 which faces outwardly. The insert 58 has a spring plate 59 for central receipt of the spring 53. An outwardly facing guiding portion 61 is arranged on the spring plate 59 and formed preferably cylindrically.

The diaphragm group 48, the spring 53 and the insert part 58 arranged on the spring 53 is surrounded by a holding element 62 and mounted to the base body 30. The holding element 62 is formed as a cap. This holding element 62 has an opening 63 in a longitudinal axis, in which the guiding portion 61 of the insert 58 is axially movably arranged. A thread is provided on inwardly facing end of the holding element 52. It engages in a threaded portion of the base body 30 which is arranged coaxially to the shoulder 56 and forms a screw connection 64. The holding element 62 is composed of metal. However, the holding element 62 can be also produced of synthetic plastic material. The screw connection 64 is preferably formed as a self-securing thread, so that the holding element 62 is secured from unintentional loosening.

The above described construction represents a pressure regulator, in which the opening pressure of the diaphragm group 48 is adjustable by the position of the holding element 62 relative to the base body 30. During the mounting of the holding element 62, the insert part 58 is loaded with a force F, so that the outwardly located part of the guiding portion 61 is arranged at a distance to the opening 63 of the holding element 62. Thereby during the adjusting process or the fixation and positioning of the holding element 62 relative to the base body 30, a torsion moment is held far from the diaphragm group 48. Therefore the diaphragm group 58 which is already fixed by the ring element 54 is not influenced, and a tight arrangement of the seat 47 to the outwardly extending pipe 45 can be maintained.

By such an arrangement and design of the pressure regulator in which first the diaphragm group 48 is fixable to the base body 30 and then is completed with the holding element 62, an arrangement is provided in which during the adjustment of the holding element 62 to the base body 30 a bending of the spring is prevented. Thereby the diaphragm 49 can not be displaced in one direction, and a tight arrangement of the diaphragm group 48 relative to the pipe 45 can be guaranteed.

The insert part 58 has a guiding portion 61 for the torsion-moment free mounting of the holding element 62. The length of the guiding portion 61 is selected so that it extends from the opening 63 of the holding element 62. Thereby during loading of the insert part 58 against the spring force during the mounting of the holding element 62 it is guaranteed that the outwardly facing part of the guiding portion 61 is spaced from the inwardly located edge of the opening 63 of the holding element 62.

The fixing of the holding element 62 to the base body 30 can be performed by further mounting types or techniques. The provision of a screw connection 64 represents a structurally simple embodiment which also makes possible an exact adjustment. In addition, by selection of the pitch of the thread, a very fine adjustment can be provided.

It will be understood that each of the elements described above, or two or more together, may also find a useful application in other types of constructions differing from the types described above.

While the invention has been illustrated and described as embodied in device for supplying internal combustion engine with fuel from supply container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for supplying an internal combustion engine with fuel, comprising a supply container from which the fuel is supplied and having an opening; a feed pump arranged in said supply container and insertable into said supply container through said opening; a closure part for closing said opening of said supply container; a pressure regulator arranged on said closure part and having a pressure chamber with a connection to a pressure side of said feed pump, to an internal combustion engine and to an unloading chamber, said closure part having a flange-shaped base body which closes said opening and is provided with a depression; a pipe formed of one piece with said body for forming a connection of said pressure chamber to said unloading chamber and extending into said depression; an elastically deformable diaphragm group which closes said depression for forming said pressure chamber, said pipe having a seat with which diaphragm group at least partially directly cooperates; a spring loading said diaphragm group toward said pipe so that during the exceeding a predetermined pressure in said pressure chamber said pipe for connecting said pressure chamber with said unloading chamber is released, said diaphragm group being mountable to said base body; a holding element arrangeable on said closure part; and an insert part engageable with said spring and movable axially relative to said holding element.

2. A device as defined in claim 1, wherein said base body is composed of synthetic plastic material.

3. A device as defined in claim 1; and further comprising a screw connection which mounts said holding element to said closure part.

4. A device as defined in claim 3, wherein said screw connection is formed as a self-securing thread.

5. A device as defined in claim 1, wherein said diaphragm group is formed so that an opening pressure of said diaphragm group is adjustable through a position to said closure part of said holding element.

6. A device as defined in claim 1, wherein said holding element is composed of metal.

7. A device as defined in claim 1, wherein said holding element is composed of synthetic plastic.

8. A device as defined in claim 1; and further comprising a separate ring element formed so that prior to mounting of the holding element said membrane group is arrangeable relative to said closure part with said separate ring element.

9. A device as defined in claim 1, wherein said insert part has a spring plate which receives said spring and a guiding portion arrangable in an opening of said holding element.

10. A device as defined in claim 9, wherein said guiding portion extends outwardly of said opening of said holding element and has a length such that during mounting of said holding element said plate spring of said insert part is arrangeable at a distance to said holding element.

* * * * *